US006101898A

United States Patent [19]

Gore et al.

[11] Patent Number: 6,101,898

[45] **Date of Patent: *Aug. 15, 2000**

[54] KNIFE AND SCISSORS SHARPENER

[75] Inventors: Fred M. Gore, Carrollton; Don H. Saller, Garland; Gerald D. Wilhite, Grapevine, all of Tex.

[73] Assignee: Jokari/US, Inc., Tarrant, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/697,273

[22] Filed: Aug. 26, 1996

[51] Int. Cl.[7] ..... B24B 3/34

[52] U.S. Cl. ..... 76/82; 76/82.2

[58] Field of Search ..... 76/82, 82.2, 88, 76/83, 86

[56] References Cited

U.S. PATENT DOCUMENTS

D. 332,210 1/1993 Linden ..... D8/93

1,051,333 1/1913 Jacoby .

*Primary Examiner*—Douglas D. Watts

*Attorney, Agent, or Firm*—Eugene F. Friedman

[57] ABSTRACT

A knife and scissors sharpener with a guard for the former. The scissors sharpener has an opening for each blade of the scissors with a cylindrical sharpening stone extending across them. The stone may rotate about an axis perpendicular to the openings to allow its positioning parallel to the cutting edges of the scissors to effectuate the sharpening of the blades. A spring normally keeps the cylindrical stone in one position, but the force exerted on the scissors' handles will cause the stone to move to its proper orientation. The knife sharpener employs two tungsten carbide sharpening elements crossed to form two V's. The sharpening elements in one V have a configuration for effectuating knife sharpening. In the other V, the elements will hone a previously sharpened knife blade. A circular disk holds the crossed sharpening elements in the handle. Rotating the holder 180° permits a change between the sharpener and the honer. A guard attaches to the holder and can rotate between opened and closed positions. In the open position, it permits the use of the sharpener and honer. To use either of these involves holding the edge of the entire mechanism on a surface. In its open configuration, the guard drops down and protects the surface from a knife undergoing sharpening. In its closed position, it rotates up against the holder so that it will occupy minimal additional space.

27 Claims, 5 Drawing Sheets

FIG. 1
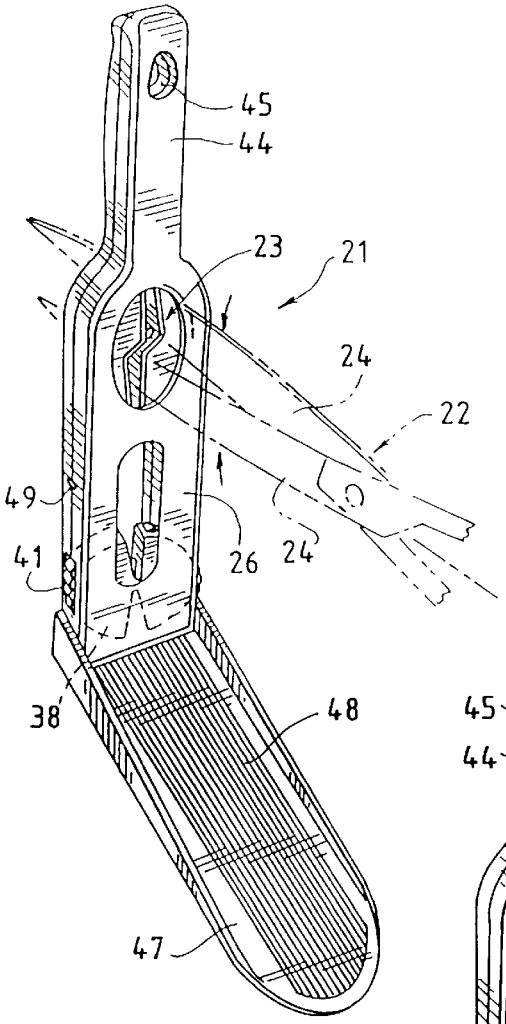
FIG. 2
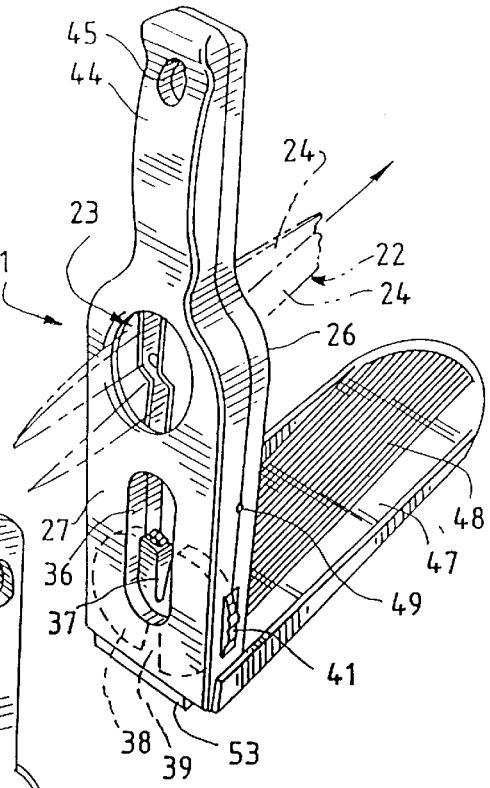
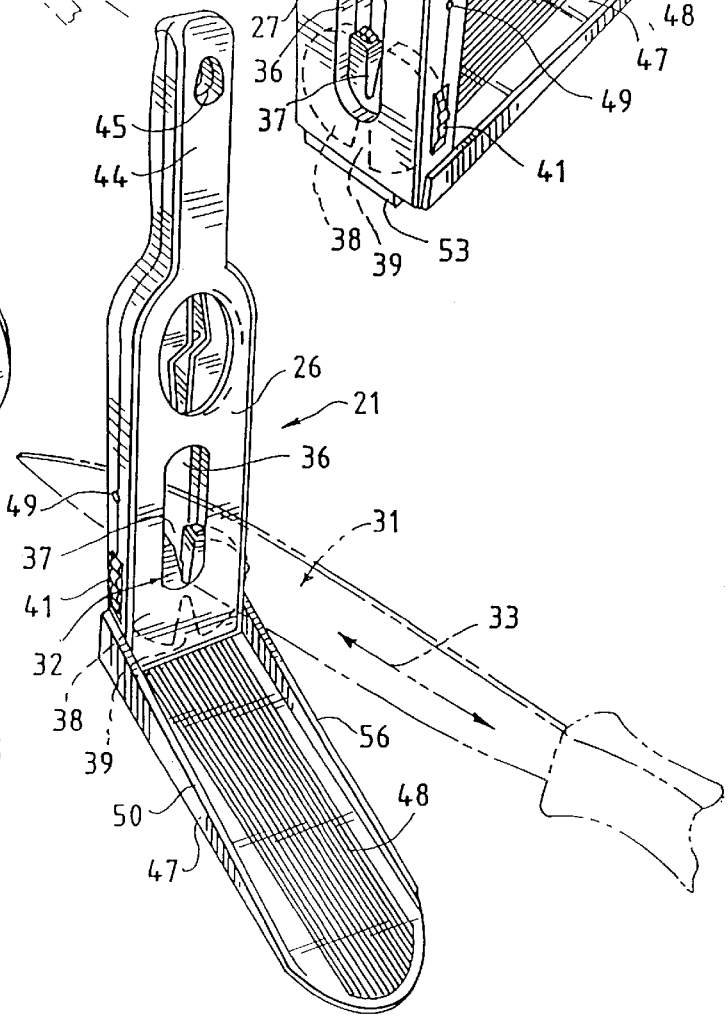
FIG. 3

KNIFE AND SCISSORS SHARPENER

BACKGROUND

Cutting instruments such as knives and scissors have found ubiquitous use in modern society. Keeping these utensils sharp has constituted a concomitant major problem following their use. The most fundamental implement for sharpening knives and scissors has taken the form of a sharpening stone. In its simplest form, the stone has a flat surface, which perhaps may form one side of a solid polygon. Ultimately, the stone may increase in sophistication into the apparatus known as a grinding wheel. This rotates a stone in the form of a solid disk about its central axis. The edge of this disk, generally having a flat configuration on planes passing through the disk's center, contacts the knife's or scissors' edge to reform it into a sharp cutting instrument.

Whatever the form the stone may assume, it has proven successful in removing adequate amounts of material from around the cutting edge of either a knife or scissors to accomplish this sharpening process. However, such stones prove difficult in use and display substantial accompanying short comes.

Thus, a flat stone rubbed manually across a knife's or scissors' edge requires substantial sophistication on the part of the user to achieve a smooth, straight edge. Otherwise, the stone may remove too much material from some part of the cutting instrument and not enough from other parts. Further, the sharpening generally should proceed in stages; otherwise, the edge of a knife, in particular, will tend to apparently bend in one direction or the other and suffer reduced effectiveness. Further, of course, the manual use of the stone exposes a person's fingers to the cutting edge with the undesirable consequences of severe lacerations.

All of the problems, with the possible exception of cutting one's fingers, become exacerbated with a rotating sharpening stone. In the classic type of rotating stone, the person effectuating the sharpening moves the knife or scissors across the edge of the stone. For all of the reasons discussed above, this requires substantial skill on part of the operator to achieve a smooth even cutting edge across the length of the knife or scissors. Furthermore, the sharpening must proceed in stages on either side of the knife until the last process refines and smoothes the edge produced by the prior stages. The final smoothing of both sides of the knife and scissors constitutes a process called "honing" which will remove burrs and minor irregularities produced by the earlier stages. All of this, again, requires substantial skill.

Recent developments in sharpening devices have attempted to overcome the problems seen with the prior devices discussed above. Thus, one electric knife sharpener attempts to place a knife at a predetermined angle against the side of a small rotating sharpening stone in the form of a disk. After completing the grinding on one side of the knife, the operator, usually an amateur, places the knife in a holder at the similar preset angle on the other side of the rotating disk to grind on the knife's second side. This type of device does simplify the process of achieving a correct angle at the knife edge. However, it does not achieve the uniform removal of material throughout the length of the knife. More importantly, it does not assist in the final or honing process. Furthermore, this type of grinding stone can easily remove far too much material from one side of the knife and almost preclude the successful achievement of a straight smooth line along the entire knife. Thus the use of the home electric sharpener still requires the use of substantial skill to achieve the desired edge. Furthermore, this type of sharpener has found very little, if any, use for improving the cutting edges of scissors.

Other knife sharpeners simply take two stones and place them together with an edge of each of the stones coming together to form a V. The V sits within some form of a holding device. The user then pulls the knife through the stones in the form of the V to simultaneously remove material from both sides of the knife's edge. While this type of device simplifies the sharpening process, it still does not adroitly guide the user through the final or honing stages of the process. In addition, pulling the knife through the V of this type of device may cause it to contact and mar the surface upon which the sharpener sits.

The development of sharpeners for scissors has taken a different tack. Current sharpeners typically include a plate having two openings into each of which one blade of the scissors passes. The openings have a diagonally arranged location relative to each other, of course, because of the relative orientation of the scissors' blades. A cutter element, typically an abrasive cylindrical rod, sits across the two openings where they meet. The actual sharpening involves placing the scissors through the plate with one blade in each opening. The operator then closes the scissors upon the sharpening rod and either pulls the scissors out or pushes it into the plate. In either event, the motion of the cutting surfaces of the scissors across the sharpening rod removes material from each of the blades to effectuate the sharpening. Placing the scissors on one side of the plate through the openings sharpens a right-handed scissors. Turning the plate around and entering the scissors through the other side accomplishes the same result for left-handed scissors. Sharpeners of this type appear in U.S. Pat. No. 1,051,333 to H. Jacoby and Des. 332,210 to O. Linden and are manufactured by Fiskars in Helsinki, Finland.

This sharpening device generally works well for most scissors. However, it loses substantial efficiency where the angle of the cylindrical bar across the two openings does not match the plane of the cutting edges of the two blades relative to their flat surfaces. This in effect can represent the result depending on the scissors' manufacturer.

Other types of sharpeners have seen regular use. Thus the leather strap found widespread use in barber shops for the honing of the straight-edge razor blade. The recent concern, however, over communicable diseases has caused barbers, even when they perform a shave, to use a disposable safety razor. The strap accordingly has lost favor since it does not serve to remove a substantial amount of the cutting edge of a knife that requires substantial sharpening.

Additionally, sharpening rods extending up to a foot or longer have found use in meat-carving sets. However, they often prove more difficult in use than sharpening stones. Furthermore, they require the operator generally to pull the knife of a blade held by one hand toward the other hand holding the sharpening rod. This of course creates the possibility of physical harm to the second hand.

SUMMARY

A device for improving a cutting edge on a knife may produce results of greater reliability where it actually incorporates two separate sections. The first improving means sharpens the knife edge. In the process, of course, it removes substantial amounts of material. The second improving means then hones the knife edge. To do so, it removes substantially less material while it smoothens out the results, including the removal of burrs, from the sharpening.

An adhering device couples to the first and second improving means and retains those components. A gripping device couples to the adhering device, and permits the manual holding by the operator of the adhering device.

An affixing device then couples to the gripping and adhering devices. It attaches the adhering device to the gripping device in a first configuration in which the first improving means occupies a position where it can improve the edge of a knife. It also attaches the adhering device to the gripping device in a second configuration in which the second improving means similarly occupies a position in which it can work upon the edge of a knife. Lastly, the affixing means permits the manual changing of the adhering device between the first and second configurations to achieve, respectively, the sharpening and honing of a knife edge.

The improvement of a cutting edge of a knife then involves first holding a gripping means. While this occurs, the edge undergoes sharpening by a first improving means retained to an adhering device attached in a first configuration to the gripping device. Subsequently, the adhering device moves to a second configuration different from the first configuration but attached to the gripping device While the operator holds the gripping means, the knife edge receives a honing with a second improving means different from the first improving means but also retained by the adhering device.

Improving the edge of a knife with a sharpening or honing mechanism held on a surface portends the damage of that surface by the knife blade itself. Especially does this constitute a danger because of the increased sharpness of the blade as a result of the work performed on it. Accordingly, the surface itself desires protection from this deleterious result.

In general, a device for use with a knife may include working means for affecting the knife's blade. It may also have a gripping device, coupled to the working means, for permitting the manual holding of the working means while the device rests upon a surface. To protect the surface, the device may include the improvement of a guard coupled to the gripping device and having first and second configurations. In the first configuration, the guard permits the working means to affect the blade of the knife. Also, while in the first configuration and with the device placed on a surface, the guard protects the surface from the blade which the working means affects. With the guard in the second configuration, it lies closer to the remainder of the device than in the first configuration. This makes the entire device more compact for facile storage.

In use, affecting the blade involves manually holding a working means. A guard means, coupled to the working means, moves to a first configuration where the working means can affect the blade of a knife. Also, in the first configuration, with the working means held upon a surface, the guard protects that surface. The working means, while manually held, is placed upon a surface. While held there and with the guard in the first configuration, the working means affects the blade of the knife.

Afterwards, the guard means is moved from the first configuration to a second configuration. There, it lies closer to the working means than in the first configuration to give an overall compact structure.

A device for sharpening a scissors, as opposed to a knife, includes a holder with a first opening for one blade of the scissors and a second opening for the other blade. The device includes a sharpening cylinder which an attaching device, coupled to the holder and to the cylinder, retains it the holder in a position where the cylinder extends across the first and second openings. It does so in a location where the cutting surfaces of both of the scissors' blades, when inserted in the openings, contact the cylinder.

An improved sharpening device results where the attaching device retains the cylinder to the holder in any one of a plurality of configurations relative to the openings. Each of the configurations in which the attaching device retains the cylinder differ from each other in the angle made by the cylinder relative to the cutting edges of scissors' blades placed in the openings. Additionally, a spring, coupled to the cylinder and to the holder, finds use in urging, under predetermined tension, the cylinder into one of its configurations. The tension which it places upon the cylinder in this configuration however remains less than about the average force manually exerted on the scissors when bringing the blades together on the cylinder for sharpening. As a result, the force on the blades will cause the cylinder to arrive at an orientation where it lies parallel to the cutting surfaces of the scissors' blades.

The sharpening of a pair of scissors involves first inserting one blade of the scissors into a first opening of a holder of a sharpening device. Additionally, the other blade of the scissors enters a second opening of the holder. The operator then places both of the blades into contact with a sharpening cylinder. An attaching device retains the cylinder to the holder in a position extending across the two openings and in a location for the cutting surface of both of the scissors blades, when inserted in the respective openings, to contact it.

The attaching device retains the cylinder in any one of a plurality of configurations relative to the openings. The configurations differ from each other in the angle made by the cylinder relative to the cutting edges of scissors placed in the openings. The cylinder is urged into one of these configurations by a spring coupled to the cylinder and to the holder.

Lastly, sufficient manual force should be exerted on the scissors to bring the blades into contact with the cylinder. Furthermore, the force on the scissors should bring the cylinder into a configuration where the axis of the cylinder lies parallel to the cutting surfaces of both blades. This provides for the efficient and effective sharpening of the scissors.

BRIEF DESCRIPTION OF THE FIGURES

FIG. 1 provides a front, left side isometric view of a scissors and knife sharpener with a guard.

FIG. 2 gives a rear, left side isometric view of the knife and scissors sharpener of FIG. 1.

FIG. 3 gives a front left side isometric view of the sharpener similar to FIG. 1 but showing a knife blade undergoing improvement.

DETAILED DESCRIPTION

Figure 4:
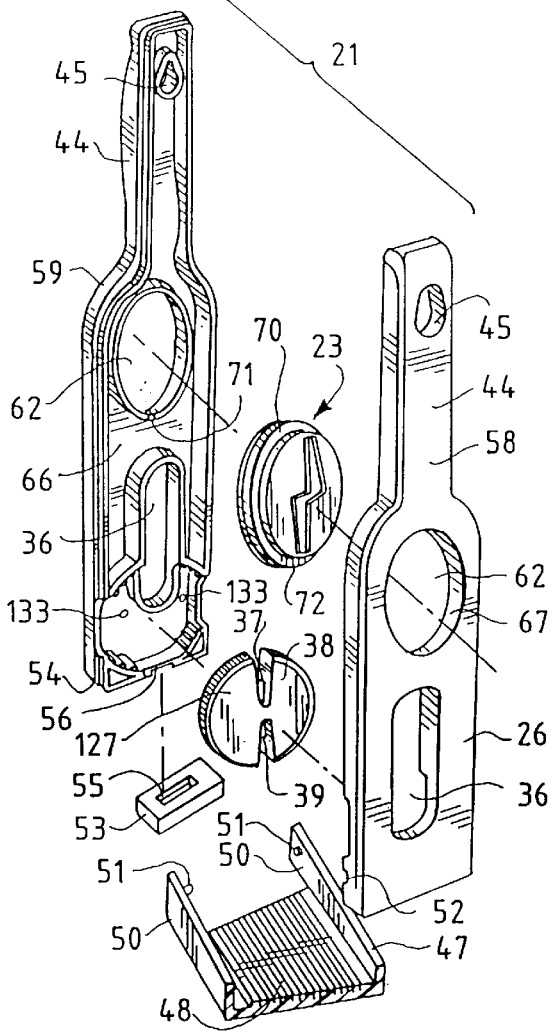
FIG. 4 provides an exploded diagram of the components of the knife and scissors sharpener of the prior figures.

FIGS. 1 to 3 show a knife and scissors sharpener generally at 21. In FIGS. 1 and 2, the scissors indicated generally at 22, in phantom, undergoes sharpening at the scissors sharpening component indicated generally at 23. There, the scissors blades 24 enter the scissors sharpener 23 from the front side 26 of the combined utensil 21. Because of its configuration, the scissors 22 can only enter the front side 26 since it has the construction of right-handed scissors. The same pair of scissors 22 cannot enter the back side 27 seen in FIG. 2. However, a pair of left-handed scissors would have the appropriate construction to enter the scissors sharpener 27 from the rear as seen in FIG. 2. Accordingly, the scissors sharpener 23 can accommodate right-handed scissors from its front side and left-handed scissors from its rear side.

FIG. 3 shows a knife in phantom generally at 31 engaging the knife sharpener shown generally at 32. As indicated by the two headed arrow 33, the knife may move either toward or away from the utensil 21 to allow the latter to work on the knife's blade. Specifically, the knife 31 has entered the opening 36 and sits in the V-shaped notch 37 of the disk 38. The notch 37 may hold the sharpener while the notch 39 holds the honer; or, the contrary may represent the situation. In any event, the knurling 41 on the edge of the disk 38 permits the rotation of the disk 38 to change between the notches 37 and 39 at the opening 36. Typically, the person sharpening the knife will contact the knurling 41 to place the notch 37 with the sharpener upward and thus in the opening 36. He will either move the knife either forward, backward, or both to effectuate the basic sharpening. Contacting the knurled edge 41 will bring the notch 39 into the opening 36. Working the knife in the notch 39 will hone the edge to provide a clean sharp knife.

As seen in FIGS. 1 to 3, the utensil 21 has the handle 44 at the top to allow the operator to securely hold it. The opening 45 allows the utensil 41 to hang from a peg or other projection from a wall.

The utensil 21 also has the guard 47 at its bottom. As shown particularly in FIG. 3, a user of the utensil 21 may pull the knife toward him and out of the opening 36. He will naturally apply a downward pressure to make sure that the knife undergoes the sharpening and honing. As he pulls it entirely out of the opening, the knife 31 may move slightly downward. The guard 37 prevents the knife, in its downward motion, from contacting and possibly marring the surface upon which utensil 21 sits. The ridged upper topography 48 in the top of the guard 47 will help prevent the knife from slipping sidewards should it entirely exit the opening 36. Furthermore, any marks left by the knife on top of the guard 47 will not create a visually displeasing scene because the ridged topography tends to hide such marks.

The guard 47 may rotate upward and sit next to the remainder of the utensil 21. This makes a more compact configuration for storage. The small knobs 49 on the sides of the utensil 21 push against the sides 50 to keep the guard 48 in its condensed configuration. As seen in the exploded view of FIG. 4, the sides 50 of the guard 47 include the pins 51. These sit in the openings 52 in which they rotate. This allows the rotation of the guard 47 upward for storage or downward for use of the utensil 21.

The rubber foot 53 attaches to the bottom 54 of the utensil body 26. It serves the purpose of keeping the utensil 21 from slipping across a surface when held there for use. The foot 53 may have a composition of Kraton® G 7820 thermoplastic rubber sold by the Shell Chemical Company of Chicago, Ill. The foot 53 has the opening 55 passing through its middle. This coincides with the opening 56 in the bottom 54 of the utensil body 26. It allows any metal shavings from operations on either a knife or scissors which may have fallen to the bottom of utensil 21 to pass to the outside.

As also seen in FIG. 4, the utensil's body 26 includes the front half 58 and the rear portion 59. The opening 36 for the knife sharpener-honer disk 38 passes through both halves 58 and 59 as does the opening 62 for the scissors sharpener 23. Similarly, the hanger opening 45 also passes entirely through the utensil 21.

The scissors sharpener 23 appears in elliptical form in FIGS. 4 to 8. The oval shape of the opening 62, naturally, matches that of the scissors sharpener 23. Specifically, the back half 59 surrounds the opening 52 with the ridge 66 while the front half 78 surrounds the opening 62 with the ridge 67. These ridges surround the scissors sharpener 23 but entrap its ridge 70 between them. The contact of the ridge 70 of the scissors sharpener 23 with the ridges 66 and 67 keep the scissors sharpener 23 firmly lodged in the utensil 21. The small knob 71 at the bottom of the ridge 66 fits into a small opening on the bottom 72 of the scissors sharpener 23 to ensure the proper relative orientation between the sharpener 23 and the remainder of the utensil 21. Any improper orientation of the scissors 23 will result in the knob 71 preventing the proper seating of the sharpener 23 in the utensil 21 by causing one portion of it to sit slightly off of the ridge 66 and wobble. Moving the sharpener 23 to the correct orientation will overcome this very visible, incorrect orientation. This also assures that right-handed scissors undergo sharpening by entry through the front half 58 of the utensil, and left-handed scissors enter through the rear half 59.

Figure 5:
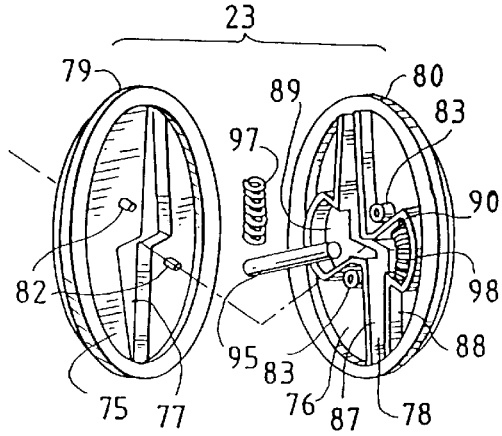
FIG. 5 gives an exploded view of the scissors component of the knife and scissors sharpener of FIGS. 1 to 4 in which coil springs place the sharpening rod in the configuration it occupies when not in contact with a scissors.

FIG. 5 gives more detail of the scissors sharpener 23 by revealing its innards. As seen there, the sharpener 23 has the two halves 75 and 76. The opening 77 passes through the former and the opening 78 passes through the latter. The raised ridge 79 on the half 75 and the raised ridge 80 on the half 78 create together the ridge 70 on the sharpener 23 seen in FIG. 4. The pins 82 on the back half 75 sit into the small cylinders 83 of the front half 76 to properly align them. The front half 76 includes the ridges 87 and 88 which surround the opening 78. However, the ridge 87 includes the pie shaped segment 89 and the ridge 88 includes the pie shaped segment 90. These pieces of pie hold the cylindrical sharpening rod 95, composed of a nominal 94% fully sintered aluminum oxide material sold under the designation AD-94 by the Coors Ceramics Company of Golden, Colo.

The coil springs 97 and 98, under compression, hold the rod 95 in the pie shaped segments 89 and 90 and rotate it toward the vertical and out of the horizontal. This mechanism receives fuller discussion in FIGS. 6 to 9 where the leaf springs 99 and 100 take the place and supply the function of the coiled springs 97 and 98 in a totally analogous fashion.

Figure 6:
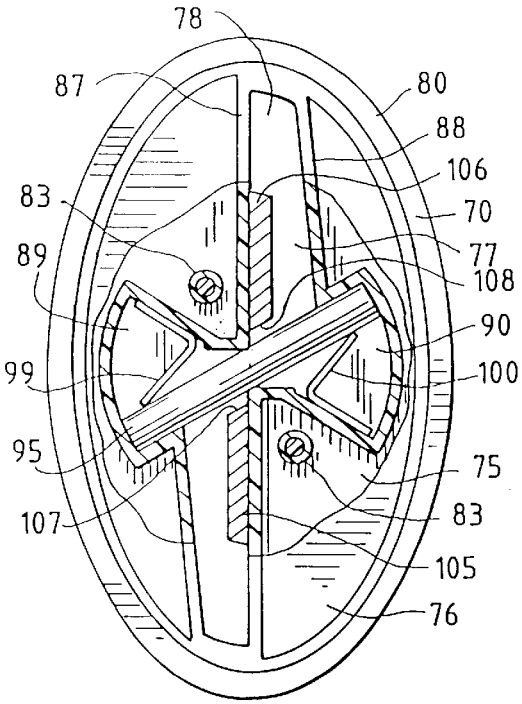
FIG. 6 gives a frontal view partially in cross section of the scissors sharpener, similar to that in FIG. 5 but employing leaf springs and before the blades of the scissors make initial contact with the sharpening rod.

As seen in the view of FIG. 6, the scissors blades 105 and 106 have passed through the opening 78 in the front half 76 and then the opening 77 in the back half 75 of the scissors sharpener 23. With reference to FIG. 6, for right-handed scissors, this would entail the blades 105 and 106 passing from on top of the page into the page. For left-handed scissors, they would have passed from beneath the page out toward the viewer.

Figure 7:
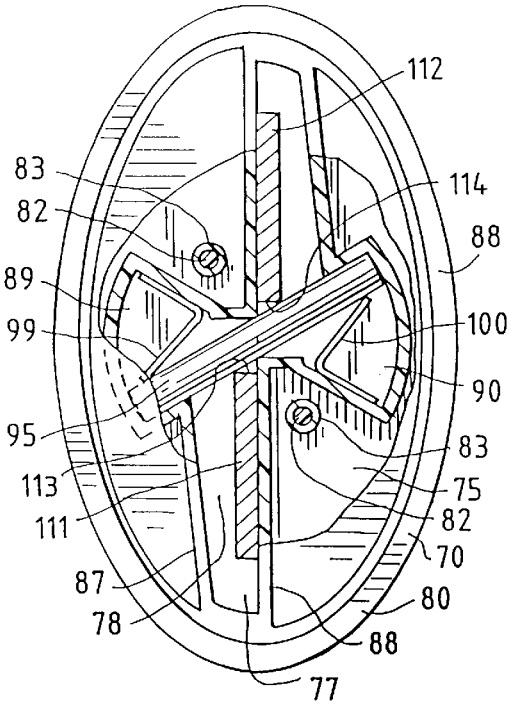
FIG. 7 gives a cross sectional view of the scissors sharpener of FIG. 6 where the scissors' blades have made initial contact with the sharpening rod.

The blades 105 and 106, however, have not yet contacted the sharpening cylinder 95. However, the cutting edges of 107 and 108 of the blades 105 and 106, respectively, virtually parallel the angle that the outer surface of the cylinder 95 makes relative to the horizontal. Merely closing the blades 105 and 106 upon each other by applying pressure to the scissors handles will cause the cutting surfaces 107 and 108 to contact the sharpening cylinder 95. Moving the scissors blades 105 and 106 back and forth will then allow the sharpening rod 95 to place the correct angle on the cutting surfaces 107 and 108 to sharpen the scissors. However, the scissors blades 111 and 112 in FIG. 7 have a different angle on their cutting surfaces 113 and 114, respectively. As seen in FIG. 7, the surfaces 113 and 114 do not lie parallel to the surface of the sharpening cylinder 95 when placed in its normal rest position by the leaf springs 99 and 100. Effectuating a sharpening in the configuration shown in FIG. 7 would obviously not put the correct angle on the cutting surfaces 113 and 114.

Figure 8:
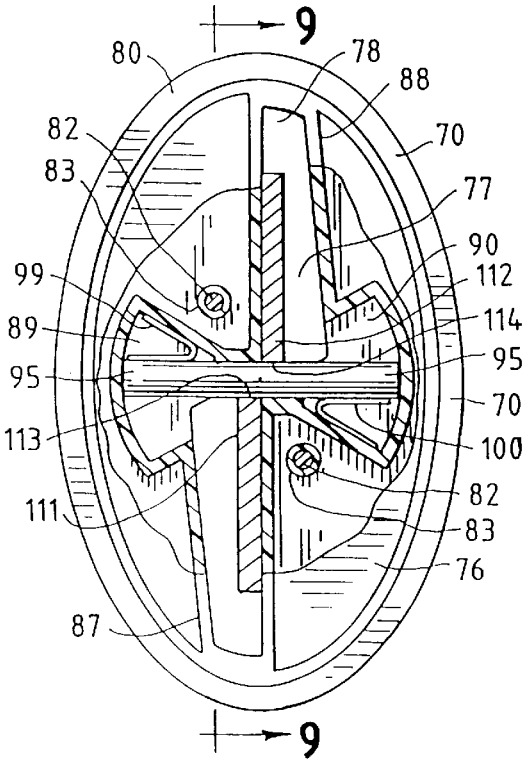
FIG. 8 gives a frontal elevation view of the scissors sharpener of FIGS. 6 and 7 in which sufficient pressure on the scissors blade has rotated the cylinder rod to where its surface lies parallel to the cutting edges of the scissors blades.
Figure 9:
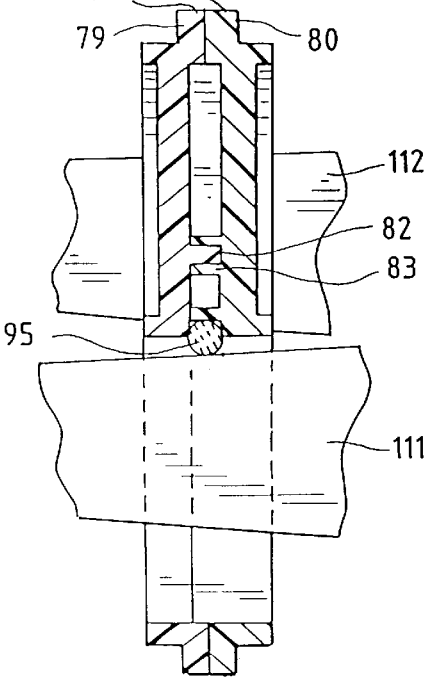
FIG. 9 gives a cross sectional view along the line 9—9 of the scissors sharpener of FIG. 8.

However, as shown in FIGS. 8 and 9, the cutting surfaces 113 and 114 have contacted the edge of the sharpening cylinder 95. The application of pressure to the handles of the scissors then caused the blades 111 and 112 to place their cutting surfaces 113 and 114, respectively, against the sharpening rod 95 and actually move it against the force of the leaf springs 99 and 100 until it occupies a more horizontal position where, more importantly, it lies flat against the cutting surfaces 113 and 114. The movement forth and back of the scissors rubs the cutting edges 113 and 114 against the cylinder 95 in its correct orientation to effectuate the desired sharpening.

Figure 10:
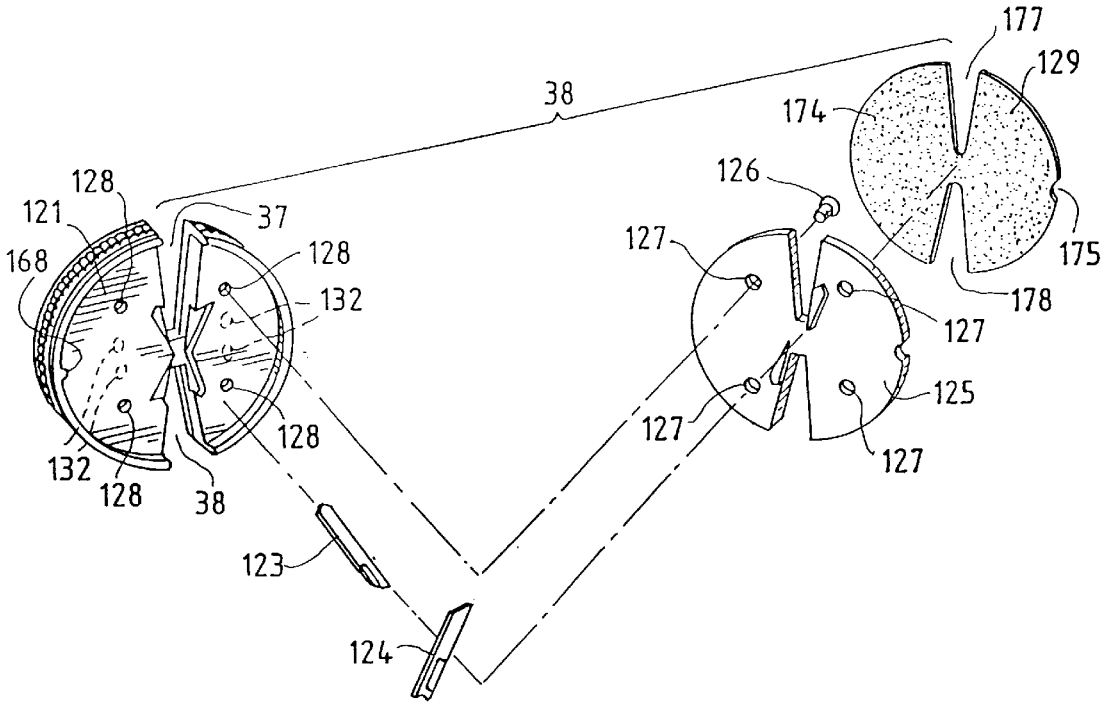
FIG. 10 gives an exploded view of the elements forming the knife sharpening component of the combined knife and scissors sharpener of FIGS. 1 to 4.
Figure 14:
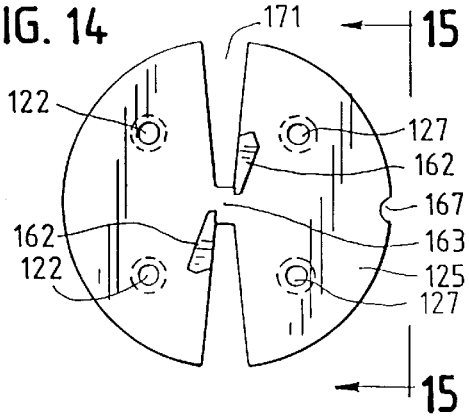
FIG. 14 gives a rear elevated view of the upper disk which holds the tungsten carbide knife sharpening elements in place within the lower disk shown in FIG. 11.
Figure 15:
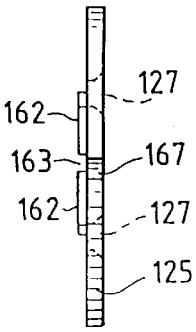
FIG. 15 gives an end elevational view along the line 15—15 of the upper disk of FIG. 14.

The disk holding the knife sharpener and honer 38 of FIG. 4 appears in the exploded view of FIG. 10. As seen there, the honer-sharpener 38 includes first the lower, or receptor, disk 21 which holds the tungsten carbide working elements 123 and 124 obtained from Duramet Corporation in Warren, Mich. The retainer disk 125, seen also in FIGS. 14 and 15, sits in the receptor disk 121 and keeps the working elements 123 and 124 in place. The screws 126 pass through the openings 127 in the retainer disk 125 and into the openings 128 of the receptor disk 121. The screws 126 keep the assembly together while the metallic overlay 129 provides a pleasing appearance to the entire assembly.

Figure 11:
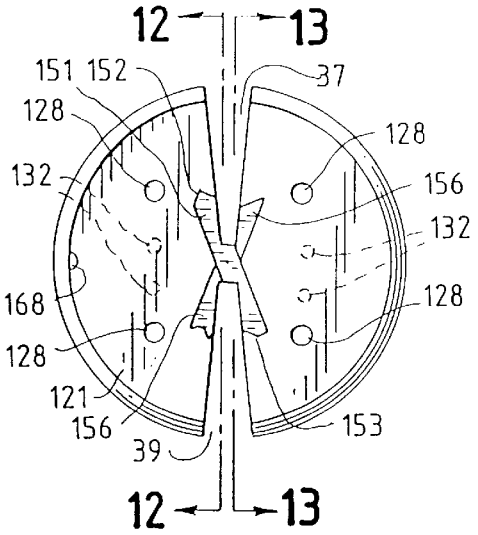
FIG. 11 provides a front elevated top view of the lower circular disk holding the crossed tungsten carbide elements that both sharpen and hone a knife blade.
Figure 12:
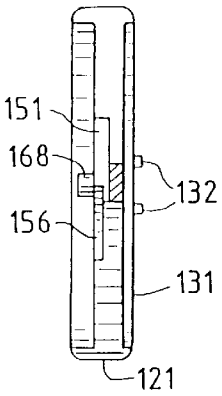
FIG. 12 gives a cross-sectional view along the line 12—12 of the lower disk of FIG. 11.
Figure 13:
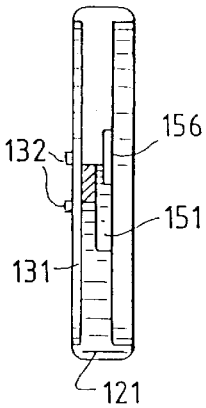
FIG. 13 provides a cross-sectional view along the line 13—13 of the lower disk of FIG. 11.

The receptor disk 121 appears in greater detail in FIGS. 11 to 13. As seen there, especially the latter two figures, the receptor 121 includes the bottom inlay 131 which gives an essentially flat surface to the bottom of the receptor disk 121. Furthermore, the inlay 131 includes the slight projections 132 which can make contact with the corresponding projections 133 in the lower back of utensil 21 seen in FIG. 4. In particular, the utensil projections 133 will fit between the receptor projections 132 to achieve the correct relative orientation between the two components. This means that the projections 132 and 133 help to orient the receptor 121 with either the sharpening opening 37 or the honing opening 38 directed upwards so that a knife placed through the opening 36 in FIG. 4 can undergo either sharpening or honing, respectively.

Figure 16:
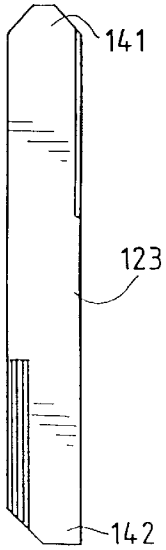
FIG. 16 gives a front, elevational top view of the two tungsten carbide knife sharpening elements utilized with the disks of FIGS. 11 and 14.
Figure 17:
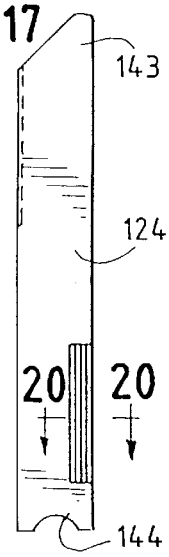
FIG. 17 shows the bottom sharpening element seen in FIG. 16.
Figure 18:
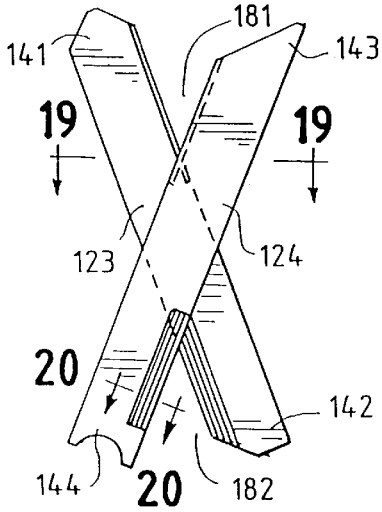
FIG. 18 shows the top sharpening element seen in FIG. 16.

The two working elements 123 and 124 appear more clearly in FIGS. 16 to 18. The two ends 141 and 142 of the rear working element 123 differ from each other and from each of the ends 143 and 144 of the front working element 124. Stated in other words, none of the ends 141 to 144 for the working elements 123 and 124 appear similar to many of the other three ends. Each of the four ends has a distinctive shape. These four unique shapes greatly facilitate the placement of the working elements 123 and 124 into the receptor disk 121. Thus, in fact, the unique shapes of the four ends 141 to 144 assure their placement into the receptor disk 121 in the configuration actually shown in FIG. 18. Accordingly, the rear element 123 must first enter the slot 151 of the receptor disk 121. As seen especially in FIG. 11, the slot 151 has the female shape to mate with the working element 123. Thus, it has the pointed end 152 to match with the pointed end 141 of the element 123. Similarly, it has a beveled corner at its end 153 to match the beveled end 142. Furthermore, the beveled end 142 prevents the incorrect placement of the working element 123 upside down in the slot 151.

After the placement of the rear working element 123 into the slot 151, the front working element 124 may enter the slot 156. Again, the unique configuration of the ends 143 and 144 permit the front working element 124 to enter the slot 156 in a single, unique manner.

Furthermore, not only must each of the working elements 123 and 124 enter their respective slots 15 and 156 with a unique orientation, they must also do so in the proper sequence. As seen in FIGS. 12 and 13 the slot 15 lies deeper into the receptor disk 121 than does the slot 156. This requires the placement of the working element 123 into the slot 15 prior to the placement of the working element 124 into the slot 156. This provides complete assurance that the working elements 123 and 124, as indicated above, can only have the relative orientation and location in the receptor disk 121 as shown in FIG. 18. No other placement of the working elements 123 and 124 will allow their proper seating in the disk 121.

As seen from FIGS. 11 and 18, the front working element 123 in the slot 151 and the working element 124 located in the slot 156 and overlying the working element 123 leave a space on the top of the working element 123. To provide its secure seating in the receptor disk 126, the retainer or cover disk 125 includes the outwardly extending tabs 162 that fit into the slot 151 over the working element 123. The small space 163 between the tabs 162 allow for the passage of the working element 124 between the tabs 162. To make sure that the tabs 162 have a proper orientation over the working element 123 in the receptor disk 121, the retainer disk 125 includes the cutout notch 167. This must find a location over the small nodule 168 on the edge of the receptor disk 121 seen in FIG. 11. Accordingly, the cover disk 125, with only a single proper orientation as permitted by the matching notch 167 and nodule 168, achieves a proper alignment over the receptor disk 121. In that unique orientation the tabs 162 fit over the ends of the working element 123 and assure its complete, secure seating in the receptor disk 121. The proper orientation of the cover disk 125 relative to the receptor disk 121 also assures that the large notches 171 and 172 of the latter align with the openings 37 and 38, respectively, of the former.

The metal cover plate 129 has the adhesive coating 174 on its lower surface. This permits it to adhere to the cover disk 125. The notch 175 in the cover plate 127 must also fit over the nodule 168 of the receptor disk 121. This assures that the cutouts 177 and 178 of the cover plate 127 overlie the notches 171 and 172 of the cover disk 125 and also the openings 37 and 38, respectively, of the receptor disk 121.

Figure 19:
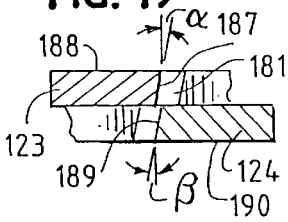
FIG. 19 gives a cross-sectional view along the line 19—19 of the crossed knife-sharpening elements seen in FIG. 16.

As discussed above, the working elements 123 and 124 must have the orientation seen in FIG. 18 when embedded in the receptor disk 121 and covered by the cover disk 125. This orientation provides the upward notch 181 and the lower notch 182 both of which have the shape in general of a V and make an angle of about 35° to 50°. The cross sectional view of the V 181 appears in FIG. 19. As seen there, placing a knife within the V 181 causes it to contact the working elements 123 and 124. Moving the knife back and forth across the working elements 123 and 124 sharpens the knife. The sharpening process removes a greater amount of metal from the knife blade than the honing process discussed below. In particular, the right surface 187 of the working element 123 in the notch 181 makes the angle $\alpha$ relative to the perpendicular rear surface 188 of that same element. This provides a very sharp contact point between the working element 123 and a knife blade in the notch 181. Similarly, the left surface 189 makes the angle $\beta$ with a perpendicular to the front surface 190 of the working element 124. Again, this provides a sharp edge in contact with a knife blade undergoing sharpening. The two sharp edges created by the surfaces 187 and 189 making the angles $\alpha$ and $\beta$ respectively, help remove sufficient material from a knife blade necessary to sharpen it. The angles $\alpha$ and $\beta$ may range from about 2° to 40°, generally lie in the range of 3 to 10 degrees, and often may amount to around 5°.

Figure 20:
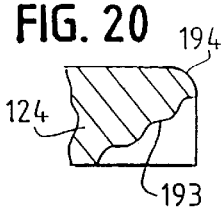
FIG. 20 gives a partial cross sectional view along the line 20—20 of the top sharpening element seen in FIG. 18.

The V notch 182 at the bottom of the working elements 123 and 124 in FIG. 18 permit the honing of a blade sharpened in the V 181. As seen in FIG. 20, each of the surfaces has the rounded grooves 193 toward the front and a rounded corner 194 toward the back. The surfaces help minimize the amount of material removed from a sharpened knife. However, it will serve to remove any burrs that have developed during the sharpening process as well as providing the final minor touches necessary for a well sharpened knife. If the thickness of the elements 123 or 124 does not suffice to permit the rounding of the corner 194, a squarer corner will not substantially and deleteriously affect the process.

Accordingly, what is claimed is:

1. A device for improving a cutting edge on a knife comprising:

(A) first improving means for sharpening a knife edge;

(B) second improving means, different from said first improving means, for honing a knife edge;

(C) adhering means, coupled to said first and second improving means, for retaining said first and second improving means;

(D) gripping means, coupled to said adhering means, for permitting the manual holding of said adhering means; and (E) affixing means, coupled to said gripping means and to said adhering means, for (1) attaching said adhering means to said gripping means in a first configuration in which said first improving means occupies a position for improving the edge of a knife and in a second configuration in which said second improving means occupies a position for improving the edge of a knife, and (2) permitting the manual changing of said adhering means between said first and second configurations.

2. The device of claim 1 wherein said first and second improving means each includes shaping means for removing material from said knife at said cutting edge.

3. The device of claim 2 wherein said shaping means in said first and second improving means takes the form respectively of first and second V's.

4. The device of claim 3 wherein said adhering means has a thin, substantially flat, planar shape.

5. The device of claim 4 wherein said affixing means attaches said adhering means rotatively to said gripping means about an axis passing substantially perpendicularly through the plane of said adhering means.

6. The device of claim 5 further including guard means, coupled to said gripping means and having first and second configurations, for, in said first configuration, (1) permitting said working means to affect the blade of a knife and (2), with said device placed on a surface, protecting said surface from said blade which said working means affects, and, in said second configuration, lying closer to said device than in said first configuration.

7. The device of claim 6 wherein said guard means has a rotatable, hinged connection to said gripping means and rotates about said hinged connection when moving between said first and second configurations.

8. The device of claim 6 wherein, when said device is manually held upon a surface, said guard means, when in said first configuration, lies upon said surface and has a ridged topography lying away from said surface with the ridges of said topography lying parallel to a knife when said device is improving a cutting edge on said knife.

9. The device of claim 5 wherein said first and second V's are each formed from the intersection of a first elongated sharpening object with a second elongated sharpening object, said first and second elongated sharpening objects being retained by said adhering means in a fixed spatial orientation relative to each other, said adhering means changing between said first and second configuration by a rotation of said adhering means relative to said gripping means of about 180°.

10. The device of claim 9 wherein said first and second elongated objects are imbedded in the material of said adhering means.

11. The device of claim 10 wherein said first and second sharpening objects have first and second shapes, respectively, and said adhering means has first and second indentations corresponding to said first and second shapes, respectively, wherein each of said first and second indentations will permit said first and second objects to be placed therein, respectively, in a unique orientation relative to said adhering means.

12. The device of claim 9 wherein said first and second objects are each substantially flat and thin, with front and back substantially flat surfaces with their edges between said front and back surfaces with said back flat surface of said first object in contact with said front flat surface of said second object and wherein with said first object has a first thin edge oriented towards said second object and second object has a second thin edge oriented towards said first object and wherein each of said first and second thin edges makes an angle of approximately 2° to 45° relative to the perpendicular to said flat surfaces of said first and second objects, said first thin edge forming a sharper angle with said front flat surface of said first object than with said back surface of said first and said second thin edge forming a sharper angle with said rear surface of said second object than with said front surface of said second object.

13. The device of claim 12 wherein said angle is approximately 5°.

14. The device of claim 9 wherein said first and second elongated sharpening objects are each substantially flat with substantially flat front and rear surfaces, and, at said second V, said second V being formed by first and second thin edges connecting said front and rear surfaces of said first and second objects, respectively, said rear surfaces of said first and second elongated objects having a rounded connection to said first and second thin edges, respectively.

15. The device of claim 9 wherein said first and second elongated objects are formed of tungsten carbide.

16. The device of claim 9 wherein said second V forms an angle between its two arms of about 35° to 50°.

17. The device of claim 9 further including detente means, coupled to said adhering means and said gripping means, for (1) indicating when each of said first and second V's has reached a particular orientation relative to said gripping means and (2) when said first or second V has reached said particular orientation relative to said gripping means, resisting the movement of said adhering means.

18. In a device for sharpen ing scissors, said device having (1) a holder with a first opening for one blade of said scissors and a second opening for the other blade, (2) a sharpening cylinder, and (3) an attaching means, coupled to said holder and said cylinder, for retaining said cylinder to said holder in a position extending across said first and second openings in a location for the cutting surface of both of said blades, when inserted in said openings, to contact it, the improvement wherein said attaching means retains said cylinder to said holder in any one of a plurality of configurations relative to said openings, each of configurations differing from the other of said configurations in the angle made by said cylinder relative to the cutting edges of scissors blades placed in said openings, said improvement also including spring means, coupled to said cylinder and to said holder, for urging, under a predetermined tension, said cylinder into one of said configuration, said tension being less than about the average force manually exerted on said scissors when bringing said blades together on said cylinder for sharpening.

19. The device of claim 18 wherein said cylinder moves between said configurations by rotating about an axis lying perpendicular to both the axis of said cylinder and the plane of said openings.

20. The device of claim 19 wherein said cylinder, when urged under said predetermined tension, moves from a position lying generally non perpendicular to the blades of the scissors placed in said openings toward a position perpendicular to the blades of said scissors.

21. The device of claim 19 wherein said spring means includes a coil spring placed under compression between said cylinder and said holder.

22. The device of claim 19 wherein said spring means includes a leaf spring placed under compression between said cylinder and said holder.

23. In a device for use with a knife compromising working means for affecting the blade of a knife and gripping means, coupled to said working means, for permitting the manual holding of said working means with said device placed on a surface, the improvement comprising guard means, coupled to said gripping means and having first and second configurations, for, in said first configuration, (1) permitting said working means to affect the blade of a knife and (2), with said device placed on a surface, protecting said surface from said blade which said working means affects, and, in said second configuration, lying closer at said device, than in said first configuration.

24. The device of claim 23 wherein said working means includes a knife sharpener or a knife honer.

25. The device of claim 24 wherein said guard means has a rotatable, hinged connection to said gripping means and rotates about said hinged connection when moving between said first and second configurations.

26. The device of claim 25 wherein, when said device is manually held upon a surface, said guard means, when in said first configuration, lies upon said surface and has a ridged topography lying away from said surface with the ridges of said topography lying parallel to a knife when said device is improving a cutting edge on said knife.

27. The device of claim 26 wherein said guard means, when in said second configuration, lies substantially flat against said gripping means and has substantially the same outline as said gripping means over a substantial portion of said gripping means.

* * * * *